US008133855B2

(12) United States Patent
Dreilinger et al.

(10) Patent No.: US 8,133,855 B2
(45) Date of Patent: Mar. 13, 2012

(54) ENVIRONMENTALLY ACCEPTABLE DILUTABLE HARD SURFACE TREATMENT COMPOSITIONS

(75) Inventors: Lisa Dreilinger, Montvale, NJ (US); Angelina Lorraine Kulbick, Montvale, NJ (US)

(73) Assignee: Reckitt Benckiser LLC, Parsippany, NJ (US)

( * ) Notice: Subject to any disclaimer, the term of this patent is extended or adjusted under 35 U.S.C. 154(b) by 0 days.

(21) Appl. No.: 12/672,733

(22) PCT Filed: Aug. 4, 2008

(86) PCT No.: PCT/GB2008/002657

§ 371 (c)(1), (2), (4) Date: Mar. 16, 2010

(87) PCT Pub. No.: WO2009/024745

PCT Pub. Date: Feb. 26, 2009

(65) Prior Publication Data

US 2011/0098210 A1 Apr. 28, 2011

Related U.S. Application Data

(60) Provisional application No. 60/956,484, filed on Aug. 17, 2007.

(51) Int. Cl.

| | |
|---|---|
| ***C11D 1/72*** | (2006.01) |
| ***C11D 3/22*** | (2006.01) |
| ***C11D 3/30*** | (2006.01) |

(52) U.S. Cl. ..... 510/421; 510/238; 510/239; 510/240; 510/250; 510/433; 510/474; 510/499; 510/535

(58) Field of Classification Search ..... 510/238, 510/239, 240, 250, 421, 433, 474, 499, 535
See application file for complete search history.

(56) References Cited

U.S. PATENT DOCUMENTS

| | | | | |
|---|---|---|---|---|
| 6,350,727 | B1 * | 2/2002 | Flower | 510/238 |
| 6,537,960 | B1 | 3/2003 | Ruhr et al. | |
| 2007/0021316 | A1 * | 1/2007 | Dilley et al. | 510/384 |

FOREIGN PATENT DOCUMENTS

| | | | |
|---|---|---|---|
| WO | 03004594 | A | 1/2003 |
| WO | 2005047445 | A | 5/2005 |
| WO | WO 2005/047445 | * | 5/2005 |

* cited by examiner

*Primary Examiner* — Brian P Mruk
(74) *Attorney, Agent, or Firm* — Norris McLaughlin & Marcus PA

(57) ABSTRACT

A dilutable concentrated hard surface cleaning composition which comprises (preferably consists essentially of): a detersive nonionic surfactant based on an alcohol alkoxylate; a detersive surfactant based on glucoside surfactants; an alkanolamine; water in an amount of at least 75% wt., preferably at least about 80% wt., and optionally one or more further optional constituents, including a polyacrylate polymer, fragrances, colorants, etc. with the proviso that the compositions exclude one or more of: (a) organic acids, (b) inorganic acids, (c) organic solvents selected from glycols, glycol ethers, ether acetates, and alcohols, (d) thickeners, and (e) chelating agents based on nitrogen containing organic compounds which include a plurality of carboxylic acid groups, preferably the compositions of the invention expressly exclude two or more, preferably three or more and yet more preferably exclude four or five of (a), (b), (c), (d) and (e).

16 Claims, No Drawings

ENVIRONMENTALLY ACCEPTABLE DILUTABLE HARD SURFACE TREATMENT COMPOSITIONS

This is an application filed under 35 USC 371 of PCT/GB2008/002657, which claims priority to U.S. Ser. No. 60/956484, filed Aug. 17, 2007.

The present invention relates to dilutable concentrated hard surface treatment compositions.

While the art is replete with hard surface cleaning compositions which are effective in the cleaning of a variety of stains which are frequently encountered on such hard surfaces, e.g., kitchen surfaces, soap scum stains and organic soils, the effective cleaning of such hard surfaces requires that in addition to water, a significant amount of chemical constituents be necessarily present in order to effectively treat the varied stains encountered on such hard surfaces.

To date the most effective cleaning compositions for the treatment of hard s surfaces typically required one or more chemicals which, while effective in treating such hard surfaces are however typically viewed as being environmentally undesirable as featuring one or more of the following characteristics: (i) is considered as being environmentally undesirable as the chemical is a volatile organic compound ("VOC"); (ii) is considered as being environmentally undesirable as the chemical does not degrade or decompose following use when flushed down sewers, drains, septic tanks or into sewage treatment facilities; (iii) is considered as being environmentally undesirable as the chemical poses an unacceptable degree of risk to aquatic life, both plant and/or animal aquatic life. Current and future environmental concerns has spurred legislation or regulations of various countries, regions or other governmental authorities to curtail or deny the use of certain such chemicals, which has reduced the degree of selection of useful chemical raw materials to a chemical formulator. However in spite of such concerns, legislation or regulations there remains a real an continuing need to meet or exceed consumer expectations in providing technically effective hard surface cleaning compositions useful in cleaning, and optionally a disinfecting or sanitizing benefit to hard surfaces and at the same time such formulations need to be considered environmentally acceptable.

It is to this and further needs that the present invention is directed. According to a first aspect of the invention there is provided an environmentally acceptable hard surface cleaning compositions Accordingly in a first aspect of the invention there is provided a dilutable concentrated hard surface cleaning composition which comprises (preferably consists essentially of):

a detersive nonionic surfactant based on an alcohol alkoxylate;

a detersive surfactant based on glucoside surfactants;

an alkanolamine;

water in an amount of at least 75% wt., preferably at least about 80% wt., and optionally one or more further optional constituents, including a polyacrylate polymer, (ACCUSOL® 445N), fragrances, colorants, etc. with the proviso that the compositions exclude one or more of: (a) organic acids, (b) inorganic acids, (c) organic solvents selected from glycols, glycol ethers, ether acetates, and alcohols, (d) thickeners, and (e) chelating agents based on nitrogen containing organic compounds which include a plurality of carboxylic acid groups. In particularly preferred embodiments the compositions of the invention expressly exclude two or more, preferably three or more and yet more preferably exclude four or five of (a), (b), (c), (d) and (e) denoted immediately above.

The foregoing compositions dilutable concentrated hard surface cleaning compositions are adapted to be diluted with at least an equivalent amount of water on a w/w % basis or v/v % basis, but desirably is adapted to be diluted with water in a respective weight ratio or volume ratio of dilutable concentrated hard surface cleaning composition: water of 1:2-100, preferably 1:3-100, more preferably 1:4-100, yet more preferably 1:5-100, still more preferably 1:10-100, and most preferably 1:16-85.

According to a second aspect of the invention therein is provided a diluted concentrated hard surface cleaning composition as described with reference to the first aspect of the invention.

In a third aspect, the present invention provides a process for the cleaning treatment, of hard surfaces which process contemplates the application to such a hard surface in need of a cleaning treatment a cleaning effective amount of the foregoing diluted or undiluted concentrated hard surface cleaning composition as described with reference to the first aspect of the invention.

According to a still further aspect of the invention there is provided a method for the manufacture of an environmentally acceptable concentrated hard surface cleanings composition useful in providing a cleaning benefit to hard surfaces.

According to a yet further aspect of the invention there is provided as a packaged dilutable product, a package containing an environmentally acceptable hard surface cleaning compositions useful in cleaning benefit to hard surfaces as are described in this patent specification.

These and other aspect or objects of the invention are disclosed in the following specification.

The compositions of the invention necessarily include a detersive nonionic surfactant based on an alcohol alkoxylate, preferably a linear primary alcohol ethoxylate, and more preferably a $C_9$-C11 alcohol ethoxylate having between 6-9 moles of ethoxylation. Such a material is commercially available as Lutensol® XL 79 (ex. BASF).

Useful as the detersive nonionic surfactant based on an alcohol alkoxylate are a variety of nonionic surfactants known to the art. Such include, nonionic surfactants produced as the condensation products of aliphatic alcohols with from about 1 to about 60 moles of an alkylene oxide, especially an ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol and the condensation product of about 9 moles of ethylene oxide with coconut alcohol (a mixture of fatty alcohols with alkyl chains varying in length from about 10 to 18 carbon atoms). Other examples are those $C_6$-$C_{18}$ straight-chain alcohols which are ethoxylated with from about 3 to about 6 moles of ethylene oxide. Their derivation is well known in the art. Examples include Alfonic® 810-4.5, which is described in product literature from Sasol as a C8-10 having an average molecular weight of 356, an ethylene oxide content of about 4.85 moles (about 60 wt. %), and an HLB of about 12; Alfonic® 810-2, which is described in product literature as a C8-10 having an average molecular weight of 242, an ethylene oxide content of about 2.1 moles (about 40 wt. %), and an HLB of about 12; and Alfonic® 610-3.5, which is described in product literature as having an average molecular weight of 276, an ethylene oxide content of about 3.1 moles (about 50 wt. %), and an HLB of 10. Other examples of alcohol ethoxylates are C10 oxo-alcohol ethoxylates available from BASF under the Lutensol® ON tradename. They are available in grades containing from about 3 to about 11 moles of ethylene oxide (available under the names Lutensol® ON 30; Lutensol® ON 50; Lutensol® ON 60; Lutensol® ON 65; Lutensol® ON 66; Lutensol® ON 70; Lutensol® ON 80; and Lutensol®ON 110). Other examples of ethoxylated alcohols include the Neodol® series non-ionic surfactants available from Shell Chemical Company which are described as $C_9$-$C_{11}$ ethoxylated alcohols. The Neodol® 91 series non-ionic surfactants of interest include Neodol® 91-2.5, Neodol® 91-6, and Neodol® 91-8. Neodol® 91-2.5 has been described as having about 2.5 ethoxy groups per molecule; Neodol 91-6 has been described as having about 6 ethoxy groups per molecule; and Neodol 91-8 has been described as having about 8 ethoxy groups per molecule. Further members of the Neodol® series including those of the Neodol® 25 series as well as the Neodol® 45 series are of particular interest, and include, inter alia, Neodol® 25-9 described as $C_{12}$-$C_{15}$ ethoxylated alcohols with about 9 ethoxy groups per molecule and Neodol® 45-7 described as $C_{14}$-$C_{15}$ ethoxylated alcohols with about 7 ethoxy groups per molecule. Other members of the Neodol® series of ethoxylated alcohols are also considered to be particularly suitable for use in the compositions of the present invention and are in certain instances, examples of preferred nonionic surfactants. Further examples of ethoxylated alcohols include the Rhodasurf® DA series non-ionic surfactants available from Rhodia which are described to be branched isodecyl alcohol ethoxylates. Rhodasurf® DA-530 has been described as having 4 moles of ethoxylation and an HLB of 10.5; Rhodasurf® DA-630 has been described as having 6 moles of ethoxylation with an HLB of 12.5; and Rhodasurf® DA-639 is a 90% solution of DA-630. Further examples of ethoxylated alcohols include those from Tomah Products (Milton, Wis.) under the Tomadol® tradename with the formula $RO(CH_2CH_2O)_nH$ where R is the primary linear alcohol and n is the total number of moles of ethylene oxide. The ethoxylated alcohol series from Tomah include 91-2.5; 91-6; 91-8—where R is linear $C_9/C_{10}/C_{11}$ and n is 2.5, 6, or 8; 1-3; 1-5; 1-7; 1-73B; 1-9; where R is linear $C_{11}$ and n is 3, 5, 7 or 9; 23-1; 23-3; 23-5; 23-6,5—where R is linear $C_{12}/C_{13}$ and n is 1, 3, 5, or 6.5; 25-3; 25-7; 25-9; 25-12—where R is linear $C_{12}/C_{13}/C_{14}/C_{15}$ and n is 3, 7, 9, or 12; and 45-7; 45-13—where R is linear $C_{14}/C_{15}$ and n is 7 or 13.

A further class of useful nonionic surfactants which find use as the alcohol alkoxylate include primary and secondary linear and branched alcohol ethoxylates, such as those based on $C_6$-$C_{18}$ alcohols which further include an average of from 2 to 80 moles of ethoxylation per mol of alcohol. These examples include the Genapol® UD (ex. Clariant, Charlotte, N.C.) described under the tradenames Genapol® UD 030, $C_{11}$-oxo-alcohol polyglycol ether with 3 EO; Genapol® UD, 050 $C_{11}$-oxo-alcohol polyglycol ether with 5 EO; Genapol® UD 070, $C_{11}$-oxo-alcohol polyglycol ether with 7 EO; Genapol® UD 080, $C_{11}$-oxo-alcohol polyglycol ether with 8 EO; Genapol® UD 088, $C_{11}$-oxo-alcohol polyglycol ether with 8 EO; and Genapol® UD 110, $C_{11}$-oxo-alcohol polyglycol ether with 11 EO.

Most preferably the alcohol alkoxylate includes a detersive nonionic alcohol ethoxylate surfactant is a $C_9$-C11 alcohol ethoxylate having between 6-9 moles of ethoxylation. Such a material is commercially available as Lutensol® XP 79 (ex. BASF). In certain preferred embodiments the detersive nonionic alcohol ethoxylate surfactant is a $C_9$-C11 alcohol ethoxylate having between 6-9 moles of ethoxylation is the sole nonionic alcohol alkoxylate surfactant present in the inventive compositions.

The detersive nonionic surfactant based on an alcohol alkoxylate is advantageously present in an amount of from about 0.001-8% wt., more preferably from 0.01-5% wt., and yet more preferably 0.01-3% wt. based on the total weight of the concentrate compositions of which they form a part. Particularly preferred amounts of the surfactants are described with reference to the Example.

The compositions of the invention further necessarily include one or more surfactants based on glucosides. Such surfactants include those based on alkylmonoglyocosides and alkylpolyglucosides and include known nonionic surfactants which are alkaline and electrolyte stable. Alkylmonoglucosides and alkylpolyglucosides are prepared generally by reacting a monosaccharide, or a compound hydrolyzable to a monosaccharide with an alcohol such as a fatty alcohol in an acid medium. Various glucoside and polyglucoside compounds including alkoxylated glucosides and processes for making them are disclosed in U.S. Pat. Nos. 2,974,134; 3,219,656; 3,598,865; 3,640,998; 3,707,535, 3,772,269; 3,839,318; 3,974,138; 4,223,129 and 4,528,106 the contents of which are incorporated by reference.

One exemplary group of such useful alkylpolyglucosides include those according to the formula:

$$R_2O—(C_nH_{2n}O)_r—(Z)_x$$

wherein:

$R_2$ is a hydrophobic group selected from alkyl groups, alkylphenyl groups, hydroxyalkylphenyl groups as well as mixtures thereof, wherein the alkyl groups may be straight chained or branched, and which contain from about 8 to about 18 carbon atoms, n has a value of 2-8, especially a value of 2 or 3;

r is an integer from 0 to 10, but is preferably 0,

Z is derived from glucose; and, x is a value from about 1 to 8, preferably from about 1.5 to 5. Preferably the alkylpolyglucosides are nonionic fatty alkylpolyglucosides which contain a straight chain or branched chain $C_8$-$C_{15}$ alkyl group, and have an average of from about 1 to 5 glucose units per fatty alkylpolyglucoside molecule. More preferably, the nonionic fatty alkylpolyglucosides which contain straight chain or branched $C_8$-$C_{15}$ alkyl group, and have an average of from about 1 to about 2 glucose units per fatty alkylpolyglucoside molecule.

A further exemplary group of alkyl glucoside surfactants suitable for use in the practice of this invention may be presented by the following formula (A):

$$RO—(R_1O)_y-(G)_x-Z_b \quad (A)$$

wherein:

R is a monovalent organic radical containing from about 6 to about 30, preferably from about 8 to 18 carbon atoms, $R_1$ is a divalent hydrocarbon radical containing from about 2 to about 4 carbon atoms, y is a number which has an average value from about 0 to about 1 and is preferably 0, G is a moiety derived from a reducing saccharide containing 5 or 6 carbon atoms; and, x is a number having an average value from about 1 to 5 (preferably from 1.1 to 2);

Z is $O_2M^1$,

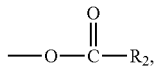

$O(CH_2)$, $CO_2M^1$, $OSO_3M^1$, or $O(CH_2)SO_3M^1$;

$R_2$ is $(CH_2)CO_2M^1$ or $CH{=}CHCO_2M^1$; (with the proviso that Z can be $O_2M^1$ only if Z is in place of a primary hydroxyl group in which the primary hydroxyl-bearing carbon atom, —$CH_2OH$, is oxidized to form a

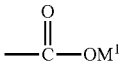

group)

b is a number of from 0 to 3x+1 preferably an average of from 0.5 to 2 per glycosal group;

p is 1 to 10, $M^1$ is $H^+$ or an organic or inorganic counterion, particularly cations such as, for example, an alkali metal cation, ammonium cation, monoethanolamine cation or calcium cation. As defined in Formula (A) above, R is generally the residue of a fatty alcohol having from about 8 to 30 and preferably 8 to 18 carbon atoms. Examples of such alkylglucosides as described above include, for example APG 325 CS Glucoside® which is described as being a 50% $C_9$-$C_{11}$ alkyl polyglucoside, also commonly referred to as D-glucopyranoside, (commercially available from Henkel KGaA) and Glucopon® 625 CS which is described as being a 50% $C_{10}$-$C_{16}$ alkyl polyglucoside, also commonly referred to as a D-glucopyranoside, (ex. Henkel).

Particularly preferred surfactants based on glucosides include those according to the following structure:

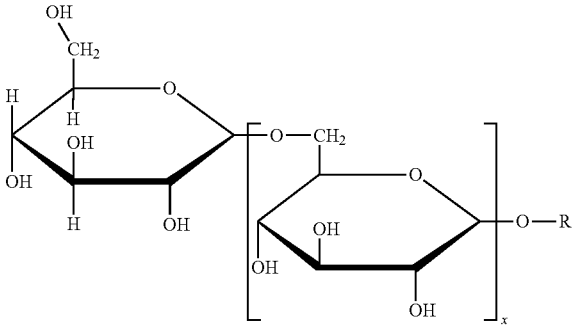

wherein:

R is an alkyl group, preferably a linear alkyl chain, which comprises $C_8$ to $C_{16}$ alkyl groups;

x is an integer value of from 0-3, inclusive.

Examples of such alkylpolyglucoside compounds according to the aforesaid structure include: where R is comprised substantially of $C_8$ and $C_{10}$ alkyl chains yielding an average value of about 9.1 alkyl groups per molecule (GLUCOPON 220 UP, GLUCOPON 225 DK); where R is comprised of $C_8$, $C_{10}$, $C_{12}$, $C_{14}$ and $C_{16}$ alkyl chains yielding an average value of about 10.3 alkyl groups per molecule (GLUCOPON 425N); where R is comprised substantially of $C_{12}$, $C_{14}$ and $C_{16}$ alkyl chains yielding an average value of about 12.8 alkyl groups per molecule (GLUCOPON 600 UP, GLUCOPON 625 CSUP, and GLUCOPON 625 FE, all of which are available from Cognis). Also useful as the alkylpolyglucoside compound is TRITON CG-110 (Union Carbide Corp. subsidiary of Dow Chemical). Further examples of commercially available alkylglucosides as described above include, for example, GLUCOPON 325N which is described as being a 50% $C_9$-$C_{11}$ alkyl polyglucoside, also commonly referred to as D-glucopyranoside (from Cognis). Particularly preferred as the surfactants based on glucosidescompounds are those illustrated in the Examples.

The surfactants based on glucosides are advantageously present in an amount of from about 0.001-8% wt., more preferably from 0.01-5% wt., and yet more preferably 0.01-3% wt. based on the total weight of the concentrate compositions of which they form a part. Particularly preferred amounts of, and identity of the surfactants based on glucosides are described with reference to the Example.

The concentrate compositions of the invention include an alkanolamine constituent. The alkanolamine constituent which provides alkalinity to the compositions, as well as simultaneously providing excellent removal of hydrophobic soils which may be encountered, e.g., greases and oils. Exemplary useful alkanolamines include monoalkanolamines, dialkanolamines, trialkanolamines, and alkylalkanolamines such as alkyl-dialkanolamines, and dialkyl-monoalkanolamines. The alkanol and alkyl groups are generally short to medium chain length, that is, from 1 to 7 carbons in length. For di- and trialkanolamines and dialkyl-monoalkanolamines, these groups can be combined on the same amine to produce for example, methylethylhydroxypropylhydroxylamine. One of skill can readily ascertain other members of this group. The alkanolamine constituent may be a single alkanolamine, or may be a plurality of alkanolamines as well.

Particularly preferred as the alkanolamine constituent is monoethanolamine which has found to be effective both as an alkalinity source and as a cleaning component. In certain particularly preferred embodiments the alkalinity constituent of the invention consists solely of a single alkanolamine, preferably selected from monoalkanolamines, dialkanolamines, trialkanolamines of 1 to 7 carbons in length, preferably is a single monoalkanolamine selected from linear monoethanolamine, monopropanolamine or monobutanolamine, and especially preferably is monoethanolamine.

Desirably the alkanolamine constituent is present in the concentrate compositions of the invention in amounts of from about 0.01%-10% by weight, more desirably from about 0.01%-2% by weight, and most preferably from about 0.01-1.25% wt. based on the total weight of the concentrate compositions of which they form a part.

The concentrate compositions of the invention are alkaline in nature, and desirably exhibit a pH of at least 8, preferably at least 9, yet more preferably exhibit a pH of at least 10, but most preferably exhibit a pH of 10.5 or more. Concurrently the concentrate compositions of the invention exhibit a pH of about 13 or less, preferably about 12 or less, and most preferably a pH of about 11.5 or less. Typically the alkalinity constituent present as an essential constituent of the concentrate compositions imparts sufficient alkalinity to the said compositions, and further imparts sufficient alkalinity to aqueous dilutions of the concentrate compositions such that they also exhibit an alkaline pH, preferably a pH of at least 8, preferably of at least 9, as well.

As is noted above, the concentrate compositions according to the invention are largely aqueous in nature. Water is added to order to provide to 100% by weight of the concentrate compositions of the invention, and desirably comprises at least 70% water, and in order of increasing preference contains 71, 72, 73, 74, 75, 76, 77, 78, 79, 80, 81, 82, 83, 84, 85, 86, 87, 88, 89, 90, 91, 92, 93, 94 and 95 percent water. Concurrently the concentrate compositions of the invention comprise, in order of increasing preference, not more than 88, 89, 90. 91. 92, 93, 94, 95, 96, 97 percent water. The water may be tap water, but is preferably distilled and is most preferably deionized water. If the water is tap water, it is preferably substantially free of any undesirable impurities such as organics or inorganics, especially minerals salts which are present in hard water which may thus undesirably interfere with the operation of the constituents present in both the concentrated compositions of the invention an in aqueous dilutions of the concentrate compositions according to the invention, such as may be formed in order to form cleaning compositions.

In certain particularly preferred embodiments the compositions of the invention expressly exclude (a) organic acids, which includes organic acids which may be represented by compounds having the following formula:

R—COOH wherein R is lower alkyl; substituted lower alkyl; hydroxy lower alkyl (e.g. $HOCH_2$—); carboxy lower alkyl (e.g. HOOC—$CH_2$—$CH_2$—); carboxy, hydroxy lower alkyl (e.g., HOOC$CH_2$CHOH—); carboxy, halo lower alkyl (e.g. HOOC$CH_2$CHBr—); carboxy, dihydroxy lower alkyl (e.g. HOOC—CHOH—CHOH—); dicarboxy, hydroxy lower alkyl

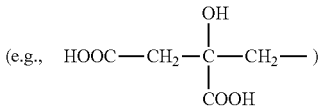

lower alkenyl, carboxy lower alkenyl (e.g. HOOCCH═CH—), dicarboxy lower alkenyl

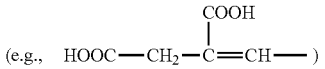

phenyl ($C_6H_5$—); substituted phenyl (e.g. hydroxy phenyl HO—$C_6H_4$—). Other acid examples include hydroxy lower alkyl e.g. lactic; carboxy, hydroxy lower alkyl, e.g. 2-methyl malic; carboxy, halo lower alkyl, e.g. 2-chloro-3-methyl succinic; carboxy, dihydroxy lower alkyl, e.g. 2-methyl tartaric; dicarboxy, hydroxy lower alkyl, e.g. 2-methyl citric acid; and carboxy lower alkenyl, e.g. fumaric. The above definitions are used in an illustrative but not a limiting sense. The term "lower" as used herein refers to an acid where "R" contains one to six carbon atoms. The term "substituted" indicates that one or more hydrogen atoms are substituted by halogen atoms (F, Cl, Br, I) hydroxyl groups, amino groups, thiol groups, nitro groups, cyano groups, etc. Examples of acids include citric, malic, succinic, lactic, glycolic, fumaric, tartaric, and formic, etc.

In certain particularly preferred embodiments the compositions of the invention expressly exclude (b) inorganic acids including: sulfuric acid, phosphoric acid, potassium dihydrogenphosphate, sodium dihydrogenphosphate, sodium sulfite, potassium sulfite, sodium pyrosulfite (sodium metabisulfite), potassium pyrosulfite (potassium metabisulfite), acid sodium hexametaphosphate, acid potassium hexametaphosphate, acid sodium pyrophosphate, acid potassium pyrophosphate, hydrochloric acid, and sulfamic acid. Other water dispersible or water soluble inorganic or mineral acids not specifically eludicated herein are also desirably excluded from certain preferred embodiments of the inventive compositions.

In certain particularly preferred embodiments the compositions of the invention expressly exclude (c) organic solvents selected from glycols, glycol ethers, ether acetates, and alcohols. Such organic solvents include $C_3$-$C_8$ alcohols which may be straight chained or branched, and which are specifically intended to include both primary and secondary alcohols. Exemplary glycol ethers include those glycol ethers having the general structure $R_a$—O—$R_b$—OH, wherein $R_a$ is an alkoxy of 1 to 20 carbon atoms, or aryloxy of at least 6 carbon atoms, and $R_b$ is an ether condensate of propylene glycol and/or ethylene glycol having from one to ten glycol monomer units. More specific examples of organic solvents excluded from the inventive compositions include: propylene glycol methyl ether, dipropylene glycol methyl ether, tripropylene glycol methyl ether, propylene glycol n-propyl ether, ethylene glycol n-butyl ether, diethylene glycol n-butyl ether, diethylene glycol methyl ether, propylene glycol, ethylene glycol, isopropanol, ethanol, methanol, diethylene glycol monoethyl ether acetate and particularly advantageously ethylene glycol hexyl ether, diethylene glycol hexyl ether, as well as the $C_3$-$C_8$ primary and secondary alcohols.

It is nonetheless to be understood that in certain further preferred embodiments in the compositions of the invention necessarily includes one or more of the (c) organic solvents selected from glycols, glycol ethers, ether acetates, and alcohols as recited more specifically above. When present such one or more organic solvents are desirably present in amounts of up to 10% wt, preferably up to about 8% wt., and yet more preferably in amounts of up to about 5% wt, based on the total weight of the compositions of which they form a part. When present the one or more organic solvents are desirably selected from glycol ethers and alcohols, particularly preferably $C_1$-$C_4$ alcohols, especially isopropyl alcohol.

In certain particularly preferred embodiments the compositions of the invention expressly exclude (d) thickeners selected from the group consisting of polysaccharide polymers selected from cellulose, alkyl celluloses, alkoxy celluloses, hydroxy alkyl celluloses, alkyl hydroxy alkyl celluloses, carboxy alkyl celluloses, carboxy alkyl hydroxy alkyl celluloses, naturally occurring polysaccharide polymers such as xanthan gum, guar gum, locust bean gum, tragacanth gum, or derivatives thereof, polycarboxylate polymers, polyacrylamides, clays, for example, colloid-forming clays, e.g., smectite and/or attapulgite types of clays, and mixtures thereof.

In certain particularly preferred embodiments the compositions of the invention expressly exclude (e) chelating agents based on nitrogen containing organic compounds which include a plurality of carboxylic acid groups. Such include, e.g., ethylenediamine mono-, di- or tri-acetic acid, ethylenediaminetetraacetic acid, N-hydroxyethylethylenediamine triacetic acid, nitrilotriacetic acid, diethylene triamine pentaacetic acid, and their water soluble salts of these compounds, especially the alkali metal salts and particularly the sodium salts.

In addition to the above recited essential constituents, the highly aqueous environmentally acceptable hard surface concentrated cleaning compositions of the invention may include one or more further optional constituents in effective amounts. Such further constituents which are usually directed to improving the aesthetic or functional features of the inventive compositions. By way of non-limiting example, such further optional constituents include: coloring agents, fragrances and fragrance solubilizers, pH adjusting agents and pH buffers including organic and inorganic salts, one or more further surfactants as co-surfactants, optical brighteners, opacifying agents, hydrotropes, preservatives, and anti-corrosion agents. When one or more of the optional constituents is added, i.e., fragrance and/or coloring agents, the esthetic and consumer appeal of the product is often favorably improved. The use and selection of these optional constituents is well known to those of ordinary skill in the art. When present, the total amount of the one or more optional constituents present in the inventive concentrate compositions do not exceed about 20% wt., preferably do not exceed 15% wt. based on the total weight of the concentrate compositions of which they form a part.

The concentrate compositions of the invention optionally but in certain cases desirably include a fragrance constituent. Such fragrances which may be natural or synthetically produced. Fragrance raw materials may be divided into three main groups: (1) the essential oils and products isolated from these oils; (2) products of animal origin; and (3) synthetic chemicals. Generally perfumes are complex mixtures or blends various organic compounds including, but not limited to, certain alcohols, aldehydes, ethers, aromatic compounds and varying amounts of essential oils such as from about 0 to about 85% by weight, usually from about 10 to about 70% by weight, the essential oils themselves being volatile odiferous compounds and also functioning to aid in the dissolution of the other components of the fragrance composition. Fragrance compositions as received from a supplier may be provided as an aqueous or organically solvated composition, and may include as a hydrotrope or emulsifier a surface-active agent, typically a surfactant, in minor amount, generally not in excess of about 1.5% wt. Such fragrance compositions are quite usually proprietary blends of many different specific fragrance compounds. However, one of ordinary skill in the art, by routine experimentation, may easily determine whether such a proprietary fragrance composition is compatible in the compositions of the present invention.

Such fragrances may be added in any conventional manner, admixing to a composition or blending with other constituents used to form a composition, in amounts which are found to be useful to enhance or impart the desired scent characteristic to the composition, and/or to cleaning compositions formed therefrom.

Further optional, but advantageously included constituents are one or more coloring agents which find use in modifying the appearance of the compositions and enhance their appearance from the perspective of a consumer or other end user. Known coloring agents. e.g., pigments and dyes including CI Direct dyes as well as FD&C approved colorants may be incorporated in the compositions in any effective amount to improve or impart to compositions a desired appearance or color. Such a coloring agent or coloring agents may be added in a conventional fashion, i.e., admixing to a composition or blending with other constituents used to form a composition. The inclusion of a coloring agent is frequently desired in that such provides improved visibility of the both the concentrate composition as well as, to a lesser extent, aqueous dilutions of the concentrate compositions and its presence on a surface being treated. Typically such one or more coloring agents are present in amounts not in excess of about 1.5% wt. yet more preferably are not present in amounts in excess of 1% wt. based on the total weight of the concentrate compositions of which they form a part.

The concentrate compositions of the invention may include one or more biodegradable chelating agents as well, which may be included in effective amounts.

The concentrate compositions may include one or more further surfactants selected from anionic, nonionic, cationic, zwitterionic and/or amphoteric surfactants as well, particularly wherein such are selected to be environmentally acceptable. Such one or more further surfactants may be included in any amount which is found to be effective in improving the cleaning efficacy of the diluted concentrate compositions taught herein.

The concentrate compositions may also include certain polymers which may improve the surface appearance characteristics of hard surfaces treated by dilutions of the concentrated compositions taught herein, which polymers include polyacrylates such as a neutralized or partially neutralized polycarboxylic acid having a nominal molecular weight in the range of about 4000-8000, presently commercially available under the tradename Acusol® 445 N (ex. Rohm & Haas), or acrylate/maleate copolymers such as are presently commercially available under the tradename Sokalan® (ex. BASF). When included, such may be present in any effective amount. Advantageously such ceratin polymers may be included in amounts of from about 0.001-5% wt., preferably ain an amount of from about 0.001-3% wt. based on the total weigh of the concentrate composition of which it forms a part.

Preservatives may also be added in minor amounts in the concentrate compositions according to the invention. Preservative compositions known in the art including commercially available preparations can be used. Examples of such preservatives compounds include those which are presently commercially available under the trademarks Kathon® CG/ICP (Rohm & Haas, Philadelphia Pa.), Suttocide® A (Sutton Labs, Chatham N.J.) as well as Midtect® TFP (Tri-K Co., Emerson, N.J.). Such preservatives are generally added in only minor amounts, i.e., amounts of about 0.5% by weight of the total concentrate composition, more generally an amount of about 0.1% by weight and less, and preferably present in amounts of about 0.05% by weight and less. Typically such preservative constituents are not necessary in the inventive compositions due to their alkaline pH.

The compositions of the invention may include one or more pH adjusting agents, or compounds which may be use to adjust the pH of the compositions, or to buffer the pH of the compositions of which they form a part.

The composition provided according to the invention can be desirably provided as a consumer product in a manually openable and resealable storage container, which may be either rigid or may be a deformable "squeeze bottle" type dispenser. With regard to the former, such are known to the art and typically comprise a flask or bottle suited for containing a quantity of the liquid composition of the invention which may be dispensed by removing a reusable closure, e.g., a cap, while the latter is also known to the art and typically comprises a deformable bottle, typically formed of a synthetic polymer such a polyolefin (e.g., polyethylene, polypropylene, etc.) or a polyalkylene terephthalate from which the liquid composition is expelled, typically via a nozzle, by a user compressing part of the deformable bottle. Either of the types of storage container described above may be used, although it is to be understood that such demonstrate preferred but non-limiting embodiments. It is clearly to be understood that any suitable storage and/or dispensing container, packaging or vessel may be used with compositions taught herein.

The concentrate compositions according to the invention are easily produced by any of a number of known art techniques. Conveniently, a part of the water is supplied to a suitable mixing vessel further provided with a stirrer or agitator, and while stirring, the remaining constituents are added to the mixing vessel, including any final amount of water needed to provide to 100% wt. of the inventive composition.

Although they may be used in their undiluted form as a composition for the cleaning treatment of hard surfaces, the concentrate cleaning compositions described are beneficially diluted to form a diluted cleaning composition therefrom. Such diluted cleaning compositions may be easily prepared by diluting measured amounts of the compositions in further amounts of water by the consumer or other end user in certain weight ratios of composition to water, and optionally, agitating the same to ensure even distribution of the composition in the water. Generally better results and faster removal are to be expected at lower relative dilutions of the composition and the water. Preferred dilution ratios of the concentrated hard surface cleaning composition: water of 1:2-100, preferably 1:3-100, more preferably 1:4-100, yet more preferably 1:5-100, still more preferably 1:10-100, and most preferably 1:16-85, on either a weight/weight ("w/w") ratio or alternately on a volume/volume ("v/v") ratio.

The compositions of the invention are advantageously used in the cleaning treatment of hard surfaces, as the hard surface cleaning composition according to the invention is desirably provided as a ready to use product which may be directly applied to a hard surface. By way of non-limiting examples, hard surfaces include surfaces composed of refractory materials such as: glazed and unglazed tile, brick, porcelain, ceramics as well as stone including marble, granite, and other stones surfaces; glass; metals; plastics e.g. polyester, vinyl; fiberglass, Formica®, Corian® and other hard surfaces known to the industry. Hard surfaces which are to be particularly denoted are lavatory fixtures such as shower stalls, bathtubs and bathing appliances (racks, curtains, shower doors, shower bars) toilets, bidets, wall and flooring surfaces especially those which include refractory materials and the like. Further hard surfaces which are to be denoted are those associated with kitchen environments and other environments associated with food preparation, including cabinets and countertop surfaces as well as walls and floor surfaces especially those which include refractory materials, plastics, Formica®, Corian® and stone.

Illustrative example compositions which were produced include those set forth below. The illustrative example composition demonstrates a particularly preferred embodiment of the invention as well as preferred weight percentages as well as preferred relative weight percentages/weight ratios with regard to the respective individual constituents present within the composition.

EXAMPLES

An example of an inventive dilutable concentrated hard surface cleaning composition is described in the following table 1; the components indicated on Table 1 are indicated on an "active weight" basis. Table 2 identifies the specific constituents used to form the dilutable concentrated hard surface cleaning composition. The amounts of the named constituents are indicated in % w/w based on a total weight of the compositions of which they form a part. Deionized water was added in "quantum sufficient" ("q.s.") to the dilutable concentrated hard surface cleaning composition so to provide the balance to 100 parts by weight of each.

TABLE 1

(Example)

| | % wt. |
|---|---|
| $C_9$-$C_{11}$ alcohol ethoxylate, 6-9 mols ethoxylation | 1.5 |
| alkyl polyglucoside | 2.45 |
| monoethanolamine | 0.75 |
| polycarboxylate polymer | 0.23 |
| fragrance | 0.35 |
| dye | 0.003 |
| deionized water | q.s. |

The resultant pH of the Example of Table 1 was evaluated and determined to fall in the range of 10.5-11.5.

The identity of the specific constituents are described on the following Table 2.

TABLE 2

| | |
|---|---|
| $C_9$-$C_{11}$ alcohol ethoxylate, 6-9 mols ethoxylation | supplied as Lutensol ® XP 79 |
| alkyl polyglucoside | supplied as Glucopon ® 425N |
| monoethanolamine | laboratory grade monoethanolamine |
| polycarboxylate polymer | supplied as Acusol ® 445N |
| fragrance | proprietary composition of its supplier |
| dye | proprietary composition of its supplier |
| deionized water | deionized water |

Cleaning Evaluation

Cleaning evaluations for greasy soils were performed in accordance with the testing protocol outlined according to ASTM D4488 A2 Test Method, which evaluated the efficacy of the cleaning compositions on masonite wallboard samples painted with wall paint. The soil applied was a greasy soil sample containing vegetable oil, food shortening and animal fat. The sponge (water dampened) of a Gardner Abrasion Tester apparatus was squirted with a 15 gram sample of a tested cleaning composition, and the apparatus was cycled 10 times. The evaluation of cleaning compositions was "paired" with one side of each of the test samples treated with a composition according to the invention, and the other side of the same sample treated with a comparative example's composition, thus allowing a "side-by-side" comparison to be made. Each of these tests were duplicated on at least 5 wallboard tiles and the results statistically analyzed and the averaged results reported on Table 3, below. The cleaning efficacy of the tested compositions were evaluated The cleaning efficacy of the tested compositions were evaluated the cleaning efficacy of the tested compositions was evaluated utilizing a high resolution digital imaging system which evaluated the light reflectance characteristics of the each tested sample wallboard sample. This system utilized a photographic copy stand mounted within a light box housing which provided diffuse, reflected light supplied by two 15 watt, 18 inch type T8 fluorescent bulbs rated to have a color output of 4100K which approximated "natural sunlight" as noted by the manufacturer. The two fluorescent bulbs were positioned parallel to one another and placed parallel and beyond two opposite sides of the test substrate (test tile) and in a common horizontal plane parallel to the upper surface of the test substrate being evaluated, and between the upper surface of the tile and the front element of the lens of a CCD camera. The CCD camera was a "QImaging Retiga series" CCD camera, with a Schneider-Kreuznach Cinegon Compact Series lens, f1.9/10 mm, 1 inch format (Schneider-Kreuznach model #21-1001978) which CCD camera was mounted on the copy stand with the lens directed downwardly towards the board of the copy stand on which a test substrate was placed directly beneath the lens. The light box housing enclosed the photographic copy stand, the two 18 inch fluorescent bulbs and a closeable door permitted for the insertion, placement and withdrawal of a test tile which door was closed during exposure of the CCD camera to a test tile. In such a manner, extraneous light and variability of the light source during the evaluation of a series of tested substrates was minimized, also minimizing exposure and reading errors by the CCD camera.

The CCD camera was attached to a desktop computer via a Firewire IEEE 1394 interface and exposure data from the CCD camera was read by a computer program, "Media Cybernetics Image Pro Plus v. 6.0", which was used to evaluate the exposures obtained by the CCD camera, which were subsequently analyzed in accordance with the following. The percentage of the test soil removal from each test substrate (tile) was determined utilizing the following equation:

$$\% \text{ Removal} = \frac{RC - RS}{RO - RS} \times 100$$

where

RC=Reflectance of tile after cleaning with test product

RO=Reflectance of original soiled tile

RS=Reflectance of soiled tile the results being reported as "% soil removal."

Cleaning evaluation for oily soil was evaluated on diluted compositions under the protocol of ASTM D-4488-89 Annex A5 for particulate soil, which evaluated the efficacy of the cleaning compositions on vinyl tile samples. The soil applied was a particulate soil sample containing natural humus, paraffin oil, used crankcase motor oil, Portland cement, silica, lampblack carbon, iron oxide, bandy black clay, stearic acid, and oleic acid produced according to the protocol. Each of the soiled test vinyl tile samples were placed into the apparatus and the center of each tile was wetted with a 20 milliliter sample of a test formulation and allowed to stand for 1 minute. When approximately 30 seconds had elapsed, a further 50 milliliter sample was applied to the sponge (water dampened, then wrung to remove excess water) of a Gardner Abrasion Tester apparatus. Thereafter the apparatus was cycled 10 times, which provided 20 strokes of the sponge across the face of each of the vinyl test tiles. The reflectance values of the cleaned samples were subsequently evaluated utilizing The cleaning efficacy of the tested compositions were evaluated utilizing a high resolution digital imaging system which evaluated the light reflectance characteristics of the each tested sample wallboard sample. This system utilized a photographic copy stand mounted within a light box housing which provided diffuse, reflected light supplied by two 15 watt, 18 inch type T8 fluorescent bulbs rated to have a color output of 4100K which approximated "natural sunlight" as noted by the manufacturer. The two fluorescent bulbs were positioned parallel to one another and placed parallel and beyond two opposite sides of the test substrate (test tile) and in a common horizontal plane parallel to the upper surface of the test substrate being evaluated, and between the upper surface of the tile and the front element of the lens of a CCD camera. The CCD camera was a "QImaging Retiga series" CCD camera, with a Schneider-Kreuznach Cinegon Compact Series lens, f1.9/10 mm, 1 inch format (Schneider-Kreuznach model #21-1001978) which CCD camera was mounted on the copy stand with the lens directed downwardly towards the board of the copy stand on which a test substrate was placed directly beneath the lens. The light box housing enclosed the photographic copy stand, the two 18 inch fluorescent bulbs and a closeable door permitted for the insertion, placement and withdrawal of a test tile which door was closed during exposure of the CCD camera to a test tile. In such a manner, extraneous light and variability of the light source during the evaluation of a series of tested substrates was minimized, also minimizing exposure and reading errors by the CCD camera.

The CCD camera was attached to a desktop computer via a Firewire IEEE 1394 interface and exposure data from the CCD camera was read by a computer program, "Media Cybernetics Image Pro Plus v. 6.0", which was used to evaluate the exposures obtained by the CCD camera, which were subsequently analyzed in accordance with the following. The percentage of the test soil removal from each test substrate (tile) was determined utilizing the following equation:

$$\% \text{ Removal} = \frac{RC - RS}{RO - RS} \times 100$$

where

RC=Reflectance of tile after cleaning with test product

RO=Reflectance of original soiled tile

RS=Reflectance of soiled tile the results being reported as "% soil removal."

The cleaning performance of the foregoing Example composition as disclosed on Table 1 was evaluated in both undiluted ("neat") form, as well as at several different aqueous dilutions.

Additionally the cleaning performance of the tested compositions were evaluated against several comparative example formulations which were produced and which are described as follows.

| Comparative 1 ("C1") | % wt. |
|---|---|
| anhydrous citric acid | 0.31 |
| benzalkonium chloride | 1.75 |
| $C_9$-$C_{11}$ linear alcohol ethoxylate, 6EO | 3 |
| isopropanol | 0.8 |
| ethanol | 0.2 |
| sodium carbonate | 1 |
| sodium hydroxide | 0.125 |
| colorant | 0.0023 |
| fragrance | 0.4 |
| silicone antifoaming agent | 0.003 |
| water | q.s. |

Test 1: Greasy Soil on Wallboard (Undiluted)

Undiluted samples of the Example formulation (see Table 1) and the "Comparative 1" formulation were both tested per the ASTM D4488 A2 Test Method.

The results of the test revealed that the "Example" formulation of the invention achieved approximately 86% soil removal, while the C1 formulation achieved only a 41% soil removal. Such a result was surprising in that an appreciable amount of organic solvents were present, as well as almost 2 times the amount of a nonionic alcohol ethoxylated surfactant, yet, less than one-half of the cleaning performance was realized.

Test 2: Greasy Soil on Vinyl Tile (Diluted 1:16)

An 1:16 aqueous dilution of the Example formulation (see Table 1) and a 1:16 aqueous dilution of the "Comparative 1" formulation were both prepared then tested per the ASTM D4488 A2 Test Method. The results of the test revealed that at the above dilutions, and on the test soils and substrates, the diluted "Example" formulation of the invention achieved approximately 43% soil removal, while the diluted C1 formulation achieved a slightly better approximately 51% soil removal. Notwithstanding the dilution, the cleaning performance of the diluted Example formulation was determined to be surprisingly good in consideration of the absence of organic solvents, and the inclusion of the nonionic surfactant at only about one-half of the nonionic surfactant was present, yet comparable cleaning was realized of the hydrophobic particulate soil used in the test.

Test 3: Greasy Soil on Wallboard (Diluted 1:83)

An 1:16 aqueous dilution of the Example formulation (see Table 1) and a 1:16 aqueous dilution of the "Comparative 1" formulation were both prepared then tested per the ASTM D4488 A2 Test Method.

The test results indicated that the "Example" formulation of the invention achieved approximately 30% soil removal, while the C1 formulation achieved only approximately a 25% soil removal. Such a result was surprising in that an appreciable amount of organic solvents were present, as well as almost 2 times the amount of a nonionic alcohol ethoxylated surfactant, yet, less than one-half of the cleaning performance was realized.

While the invention is susceptible of various modifications and alternative forms, it is to be understood that specific embodiments thereof have been shown by way of example in the drawings which are not intended to limit the invention to the particular forms disclosed; on the contrary the intention is to cover all modifications, equivalents and alternatives falling within the scope and spirit of the invention as expressed in the appended claims.

The invention claimed is:

1. A dilutable concentrated hard surface cleaning composition which consists of:

a detersive nonionic surfactant based on an alcohol alkoxylate;

a detersive surfactant based on a glucoside surfactant an alkanolamine;

water in an amount of at least 75% wt., and optionally one or more further optional constituents selected from: coloring agents, fragrances, fragrance solubilizerents, pH adjusting agents, pH buffers, optical brighteners, opacifying agents, hydrotropes, preservatives and anti-corrosion agents with the proviso that the compositions exclude (c) organic solvents selected from glycols, glycol ethers, ether acetatcs, and alcohols, as well as further excluding one or more of: (a) organic acids, (b) inorganic acids, (d) thickeners, and (e) chelating agents based on nitrogen containing organic compounds which include a plurality of carboxylic acid groups.

2. An aqueous dilution of the dilutable concentrated hard surface cleaning composition according to claim 1 wherein the said composition is diluted with water in a respective weight ratio or volume ratio of dilutable concentrated hard surface cleaning composition: water of 1:2-100.

3. An aqueous dilution of the dilutable concentrated hard surface cleaning composition according to claim 2 wherein the said composition is diluted with water in a respective weight ratio or volume ratio of dilutable concentrated hard surface cleaning composition: water of 1:10-100.

4. An aqueous dilution of the dilutable concentrated hard surface cleaning composition according to claim 3 wherein the said composition is diluted with water in a respective weight ratio or volume ratio of dilutable concentrated hard surface cleaning composition: water of 1:16-85.

5. A dilutable concentrated hard surface cleaning composition according to claim 1 which exclude at least two or more of: (a) organic acids, (b) inorganic acids, (d) thickeners, and (e) chelating agents based on nitrogen containing organic compounds which include a plurality of carboxylic acid groups.

6. A dilutable concentrated hard surface cleaning composition according to claim 5 which exclude at least three or more of: (a) organic acids, (b) inorganic acids, (d) thickeners, and (e) chelating agents based on nitrogen containing organic compounds which include a plurality of carboxylic acid groups.

7. A dilutable concentrated hard surface cleaning composition according to claim 6 which exclude each of: (a) organic acids, (b) inorganic acids, (d) thickeners, and (e) chelating agents based on nitrogen containing organic compounds which include a plurality of carboxylic acid groups.

8. A dilutable concentrated hard surface cleaning composition according to claim 1 comprising 0.01-5% wt. of a detersive nonionic surfactant based on an alcohol alkoxylate.

9. A dilutable concentrated hard surface cleaning composition according to claim 8 comprising 0.01-4% wt. of a detersive nonionic surfactant based on an alcohol alkoxylate.

10. A dilutable concentrated hard surface cleaning composition according to claim 1 wherein a $C_9$-$C_{11}$ alcohol ethoxylate having between 6-9 moles of ethoxylation is the sole nonionic alcohol alkoxylate surfactant present in the composition.

11. A dilutable concentrated hard surface cleaning composition according to claim 1 comprising 0.01-5% wt. of a glucoside surfactant.

12. A dilutable concentrated hard surface cleaning composition according to claim 11 comprising 0.01-3% wt. of a glucoside surfactant.

13. A dilutable concentrated hard surface cleaning composition according to claim 1 comprising 0.01% -2% by weight of an alkanolamine.

14. A dilutable concentrated hard surface cleaning composition according to claim 13 comprising 0.01-1.25% wt. of an alkanolamine.

15. A dilutable concentrated hard surface cleaning composition according to claim 1 having a pH of at least 10.

16. A dilutable concentrated hard surface cleaning composition which comprises:

a detersive nonionic surfactant based on an alcohol alkoxylate;

a detersive surfactant based on a glucoside surfactant an alkanolamine;

water in an amount of at least 75% wt., and optionally one or more further optional constituents selected from: coloring agents, fragrances, fragrance solubilizers, pH adjusting agents, pH buffers, optical brighteners, opacifying agents, hydrotropes, preservatives and anti-corrosion agents, with the proviso that the compositions exclude each of: (a) organic acids, (b) inorganic acids, (c) organic solvents selected from glycols, glycol ethers, ether acetates, and alcohols, (d) thickeners, and (e) chelating agents based on nitrogen containing organic compounds which include a plurality of carboxylic acid groups.

* * * * *